US005285031A

United States Patent [19]

Schueneman

[11] Patent Number: 5,285,031

[45] Date of Patent: Feb. 8, 1994

[54] PENDULUM-ACTIVATED SWITCH ASSEMBLY

[75] Inventor: Arthur R. Schueneman, Elgin, Ill.

[73] Assignee: Elgin Die Mold Co., Elgin, Ill.

[21] Appl. No.: 959,683

[22] Filed: Oct. 13, 1992

[51] Int. Cl.[5] ..... H01H 35/14

[52] U.S. Cl. ..... 200/61.48; 200/61.51

[58] Field of Search ..... 200/61.48, 61.49, 61.51, 200/61.52, 61.62, 60, 61.45 R, 61.83

[56] References Cited

U.S. PATENT DOCUMENTS

| | | | |
|---|---|---|---|
| 1,649,059 | 11/1927 | Davis . | |
| 2,107,570 | 2/1938 | Hobbs | 240/2 |
| 2,228,456 | 1/1941 | Hobbs | 240/2 |
| 2,322,549 | 6/1943 | Sorensen | 200/52 |
| 2,344,129 | 3/1944 | Clayton | 200/52 |
| 2,485,170 | 10/1949 | Roetter | 200/166 |
| 2,601,142 | 6/1952 | Hubbard | 315/32 |
| 2,793,261 | 5/1957 | Towle et al. | 200/61.51 |
| 3,835,273 | 9/1974 | Stolarik | 200/61.48 |
| 3,898,400 | 8/1975 | Takada | 200/61.48 |
| 3,937,002 | 2/1976 | Van Haaften | 58/23 BA |
| 4,241,940 | 9/1980 | Roth | 200/61.45 R |
| 4,262,177 | 4/1981 | Paxton et al. | 200/61.45 R |
| 4,321,438 | 3/1982 | Emenegger | 200/61.45 R |
| 4,467,154 | 8/1984 | Hill | 200/61.45 R |
| 4,513,183 | 4/1985 | Hill | 200/61.45 R |
| 4,683,521 | 7/1987 | Poleschuk et al. | 362/80 |
| 4,755,640 | 7/1988 | Cooley | 200/84 R |
| 4,820,888 | 4/1989 | Shields | 200/61.45 M |
| 4,956,629 | 9/1990 | Chen | 340/429 |
| 5,010,216 | 4/1991 | Sewell | 200/61.45 M |
| 5,059,751 | 10/1991 | Woodman | 200/61.45 M |

*Primary Examiner*—A. D. Pellinen
*Assistant Examiner*—Michael A. Friedhofer
*Attorney, Agent, or Firm*—Dressler, Goldsmith, Shore & Milnamow, Ltd.

[57] ABSTRACT

A pendulum-activated switch assembly includes a housing comprising first and second housing portions which define an interior cavity. A pendulum is pivotally mounted within the interior cavity, with pivotal movement of the pendulum controlling the flow of electrical current through the switch assembly. A plurality of electrodes are provided, with the illustrated embodiment including integral connector and bulb sockets. The switch assembly can be configured for position-responsive or inertial-responsive applications.

8 Claims, 1 Drawing Sheet

PENDULUM-ACTIVATED SWITCH ASSEMBLY

TECHNICAL FIELD

The present invention relates generally to electrical switch assemblies such as for automotive use, and more particularly to a pendulum-activated switch assembly which can be configured for position-sensitive or inertial activation.

BACKGROUND OF THE INVENTION

Automobiles and like motor vehicles typically include dozens of electrical switch assemblies for controlling all manner of electrical devices in the vehicle. One type of switch which is quite common can generally be considered of the position-reactive type, wherein the particular positioning of the switch effects its actuation. For example, switches of this type can be used on trunk lids or hoods for controlling interior lights attendant to opening and closing of the associated structure. While mercury switches have typically been employed for this type of application, concern regarding the adverse impact on the environment by the highly toxic mercury is mandating that these types of switches no longer be employed.

Another type of switch which has become increasingly important for automotive use is of the socalled inertial type, wherein the switch is activated in response to acceleration which exceeds a predetermined level. Switches of this type can be employed in connection with activation of air bags, or other vehicle systems which are activated in response to impact or the like on the vehicle.

The present invention is directed to a switch assembly, which can be embodied with an integral light bulb socket, with the switch assembly being versatile in application, and readily manufactured for economical use.

SUMMARY OF THE INVENTION

The pendulum-activated switch assembly embodying the principles of the present invention is configured for economical manufacture, reliable and consistent operation, and versatile use in motor vehicles or like applications. The construction includes a two-piece housing within which is mounted a pivotal pendulum which controls flow of electrical current through associated electrodes. The configuration of the assembly promotes its economical manufacture, with a straightforward design promoting reliable and consistent operation.

In accordance with the illustrated embodiment, the present switch assembly comprises a housing including first and second housing portions positioned in juxtaposed relationship to each other. The housing may be configured in a generally box-like form, and defines an interior cavity. In the illustrated embodiment, the housing includes a bulb socket for receiving an associated light bulb.

The switch assembly includes a plurality of electrodes mounted on the housing for connection with associated electrical circuitry. A pair of electrodes are provided which each have a portion disposed outside of the interior cavity of the housing for connection with the associated circuitry. A first one of these electrodes includes a support portion disposed within the cavity, while a second one of the electrodes extends through a passage defined between the first and second housing portions, and includes a socket portion positioned in the bulb socket of the assembly.

The present switch assembly further includes a pivotal pendulum which is pivotally mounted on the support portion of the one electrode within the interior cavity. By this arrangement, pivotal movement of the pendulum controls flow of electrical current through the associated electrodes. To this end, a contact electrode is provided which extends from within the interior cavity into the bulb socket, so that the pendulum is movable into and out of contact with the contact electrode for controlling flow of current to the light bulb.

To facilitate secure support of the pendulum of the assembly, the illustrated embodiment is configured such that each of the first and second housing portions includes an integral mounting boss, with the bosses positioned in confronting relationship generally within the interior cavity. The support portion of the first electrode extends between the mounting bosses, with the pendulum positioned between the bosses, thus securely supporting the pendulum for pivotal movement.

Other features and advantages of the present invention will become readily apparent from the following detailed description, the appended drawings, and the accompanying claims.

DETAILED DESCRIPTION

Figure 1:
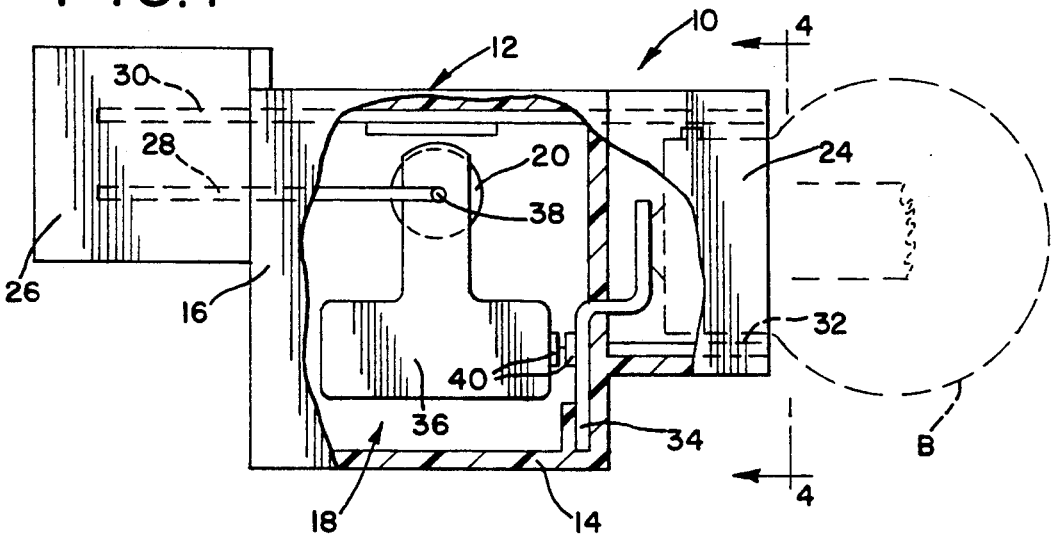
FIG. 1 is an elevational view, in partial cross-section, illustrating the pendulum-activated switch assembly embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to the drawings, therein is illustrated a switch assembly 10 embodying the principles of the present invention. While the illustrated embodiment of the present switch assembly includes, as will be further described, an integral light bulb socket, it will be understood that such an arrangement is optional, depending upon the intended application of the switch assembly. Inclusion of such an integral socket can be desirable when the switch is intended for position-responsive activation, such as when the switch is mounted on an automobile hood or trunk lid, and is intended to activate the associated light bulb when the hood or trunk lid is raised.

Figure 2:
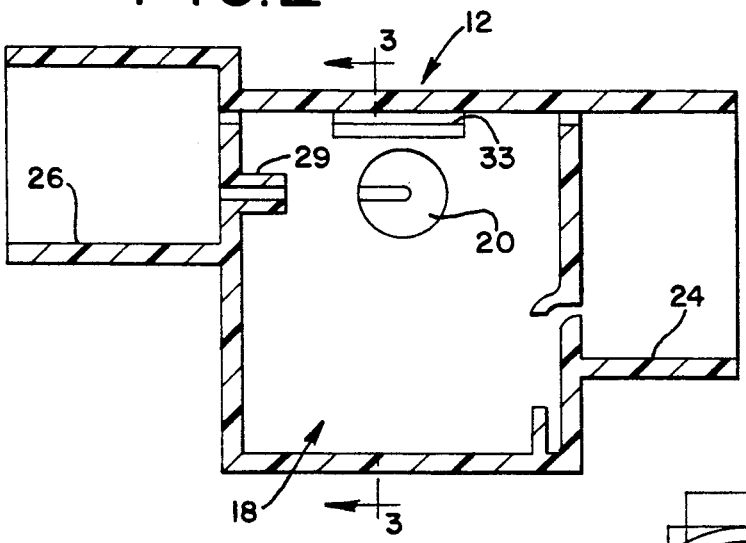
FIG. 2 is a cross-sectional view of a housing of the present switch assembly.
Figure 3:
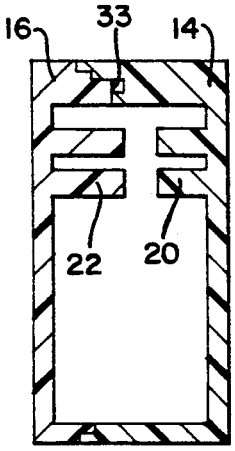
FIG. 3 is a view taken along lines 3—3 of FIG. 2 further illustrating the housing of the present switch assembly.

As is evident, the configuration of switch assembly 10 is desirably straightforward, thus promoting economical manufacture and reliable operation. The switch assembly includes a generally box-like housing 12, which in the preferred form comprises injection-molded first housing portion 14 and second housing portion 16 (FIG. 3). The first and second housing portions are positioned and secured together in juxtaposed relationship, thereby defining an interior cavity 18 generally between the housing portions (see FIGS. 1 and 2). The housing portions may be secured together by any of a variety of suitable arrangements, including adhesive bonding, sonic bonding, or mechanical fasteners.

In a preferred form, each of the housing portions includes an integral mounting boss, respectively designated 20, 22, (FIG. 3) to facilitate mounting of the associated pendulum of the construction. As illustrated, the mounting bosses 20, 22 are positioned in confronting relationship generally within the interior cavity, for supporting the associated pendulum, as will be further described.

Figure 4:
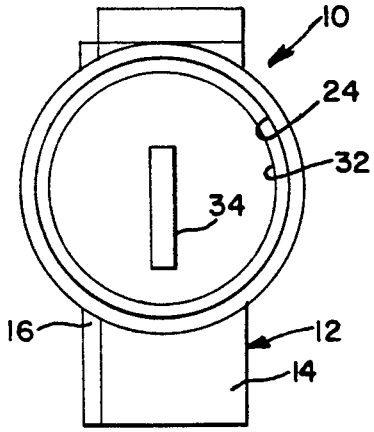
FIG. 4 is a view taken along lines 4—4 of FIG. 1 further illustrating the present switch assembly.

In accordance with the illustrated embodiment, the present switch assembly includes a bulb socket 24 (best shown in FIGS. 1 and 4) for receiving an associated light bulb B (illustrated in phantom line), and a connector socket 26 for receiving an associated electrical connector for effecting connection with associated electrical circuitry. In the illustrated configuration, the bulb socket 24 and the connector socket 26 are positioned generally at respective opposite sides of the interior cavity 18, with the bulb socket and connector socket preferably being integrally formed with the first housing portion 14. In this configuration, the second housing portion 16 is positioned generally between the bulb socket and the connector socket. However, it will be understood that this specific configuration can be varied while keeping with the principles disclosed herein.

The present switch assembly includes an arrangement of electrodes for connection with the associated circuitry of a motor vehicle or the like. Specifically, a pair of electrodes are provided which each include a portion disposed outside of the interior cavity (within connector socket 26 in the illustrated form) for connection with associated circuitry.

More specifically, a first electrode 28 (FIG. 1) extends from within the interior cavity into connector socket 26, through an integral support sleeve 29 (FIG. 2) of the first housing portion 14. A second electrode 30 also includes a portion disposed within connector socket 26, with the second electrode extending generally through the housing 12. As illustrated, in FIG. 1 the electrode 30 extends through a passage 33 defined between the first and second housing portions, thus facilitating assembly and positioning of the second electrode.

To further facilitate assembly, the second electrode includes an integral, generally cylindrical socket portion 32 which fits within the bulb socket 24 of the housing.

A contact electrode 34 (FIG. 1) is provided for electrical connection to light bulb B. The contact electrode 34 extends from within the interior cavity 18 into the bulb socket 24, and is preferably of a generally Z-shaped configuration.

Control of current flow through the switching assembly is provided by an electrically-conductive pendulum 36 (see FIG. 1) positioned within interior cavity 18. Pivotal mounting of the pendulum 36 is provided by a support portion 38 of first electrode 28, which support portion functions as a pivot for supporting the pendulum. The support portion preferably extends between the confronting bosses 20, 22, with a portion of the pendulum 36 positioned generally therebetween, with the pendulum thus securely supported for pivotal movement.

Control of electrical current is effected by the provision of contact points 40 (see FIG. 1) respectively provided on pendulum 36 and the contact electrode 34. Depending upon the desired application of the switch assembly, the contact points 40 open and close attendant to pivotal movement of the pendulum 36, thus controlling current flow through the switch assembly. In the illustrated embodiment, current to light bulb B is provided via first electrode 28, pendulum 36, and contact electrode 34, with second electrode 30 (including its socket portion 32) completing the circuit.

The housing of the present switch assembly is preferably formed from injection-molded plastic material, such as polystyrene, polycarbonate, or the like. Electrodes 28, 30, and 34 are preferably formed from suitably conductive metallic material, with pendulum 36 also comprising suitably conductive metallic material, such as die cast zinc or the like.

While the present switch assembly 10 has been illustrated in an orientation wherein the pendulum depends from the support portion 38, the switch assembly can be otherwise positioned, by including a generally inverted orientation wherein the pendulum moves pivotally above its pivoted support.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A pendulum-activated switch assembly, comprising:

a housing including first and second housing portions positioned in juxtaposed relationship to each other, and defining an interior cavity, each of said first and second housing portions including an integral mounting boss, said bosses being disposed in generally confronting relationship with each other within said interior cavity, electrode means mounted on said housing for connection to associated electrical circuitry, said electrode means comprising a pair of electrodes each having a portion disposed outside of said interior cavity for connection to said circuitry, a first one of said electrodes including a support portion disposed within said cavity and extending between said pair of mounting bosses, said electrode means further comprising a contact electrode having a portion positioned within said interior cavity; and electrically conductive pendulum means pivotally mounted on said support portion of said first electrode within said interior cavity so that pivotal movement of said pendulum causes said pendulum to contact said contact electrode to electrically join said first electrode and said contact electrode to control flow of current through said electrode means.

2. A switch assembly in accordance with claim 1, wherein a second one of said electrodes extends through a passage defined between said first and second housing portions.

3. A switch assembly in accordance with claim 2, wherein said housing defines a bulb socket for receiving an associated light bulb, said second electrode extending into said bulb socket for supplying current to said bulb.

4. A switch assembly in accordance with claim 3, wherein said contact electrode extends from within said interior cavity into said bulb socket, said pendulum means being movable into and out of contact with said contact electrode for controlling flow of current to said light bulb.

5. A switch assembly in accordance with claim 1, wherein said housing defines a bulb socket for receiving an associated light bulb, and a connector socket for receiving an associated connector for connection to said electrode means, said bulb socket and said connector socket each being integral with said first housing portion, with said second housing portion being positioned generally between said bulb socket and said connector socket.

6. A switch assembly in accordance with claim 5, wherein a second one of said electrodes extends through a passage defined between said first and second housing portions from said connector socket to said bulb socket, and includes a socket portion positioned in said bulb socket for electrical connection to said associated light bulb.

7. A pendulum-activated switch assembly, comprising:

a housing including first and second housing portions positioned in juxtaposed relationship to each other, and including wall means having end portions in abutting engagement with one another defining an interior cavity, said housing defining a bulb socket for receiving an associated light bulb, said housing further defining integrally formed boss means, one such boss means being formed in each of said first and second housing portions;

electrode means mounted on said housing for connection to associated electrical circuitry, said electrode means comprising a pair of electrodes each having a portion disposed outside of said interior cavity for connection to said circuitry, a first one of said electrodes including a support portion disposed within said cavity and supported within said interior cavity by said boss means, and a second one of said electrodes extending through a passage defined between said abutting end portions of the wall means of said first and second housing portions and including a socket portion positioned in said bulb socket; and electrically conductive pendulum means pivotally mounted on said support portion of said first electrode within said interior cavity so that pivotal movement of said pendulum controls flow of current through said means, said electrode means further comprising a contact electrode extending from within said interior cavity into said bulb socket, said pendulum means being movable into and out of contact with said contact electrode for electrically joining said first electrode and said contact electrode for controlling flow of current to said light bulb.

8. A switch assembly in accordance with claim 7, wherein said housing includes mounting base means positioned within said interior cavity for receiving said support portion of said first electrode.

* * * * *